United States Patent [19]

Shimoda

[11] Patent Number: 4,716,395

[45] Date of Patent: Dec. 29, 1987

[54] MULTI-ROTATION TYPE POTENTIOMETER

[75] Inventor: Eitaro Shimoda, Kawasaki, Japan

[73] Assignee: Sakae Tsushin Kogyo Co., Ltd., Kanagawa, Japan

[21] Appl. No.: 12,352

[22] Filed: Feb. 9, 1987

[51] Int. Cl.[4] ..... H01C 10/24

[52] U.S. Cl. ..... 338/149; 338/143

[58] Field of Search ..... 338/143, 144, 145, 146, 338/147, 149, 79, 162, 163, 164

[56] References Cited

U.S. PATENT DOCUMENTS

| | | | |
|---|---|---|---|
| 3,537,055 | 10/1970 | Simon et al. | 338/149 |
| 3,887,891 | 6/1975 | Tice | 338/149 X |
| 4,081,780 | 3/1978 | Rhind et al. | 338/164 |

FOREIGN PATENT DOCUMENTS

| | | | |
|---|---|---|---|
| 1215489 | 12/1970 | United Kingdom | 338/149 |

*Primary Examiner*—E. A. Goldberg
*Assistant Examiner*—M. M. Lateef
*Attorney, Agent, or Firm*—Murray Schaffer

[57] ABSTRACT

A multi-rotation type potentiometer having an additional stopper member rotatable so as to set a rotation angle of the potentiometer or its sliding member to any angle.

9 Claims, 4 Drawing Figures

MULTI-ROTATION TYPE POTENTIOMETER

BACKGROUND OF THE INVENTION

1. Field of the Invention

The present invention relates generally to potentiometers and, more particularly, is directed to a multi-rotation type potentiometer in which a rotation angle of its sliding member is limited to a desired angle.

2. Description of the Prior Art

Multi-rotation type potentiometers have been mass-produced so far and most of them are designed to have a specified rotation angle (specified number of revolution). The number of revolutions or turns of the multi-rotation type potentiometer or its sliding member or its spiral resistance wire generally produced is selected as 3, 5, 10, 15 and 20. Among them, the most numerous is the potentiometer that has the number of revolution selected as 10. However, since the multi-rotation type potentiometer is used in various purposes, it is frequently requested that a multi-rotation type potentiometer has a rotation angle of its sliding member or spiral resistance wire such as 4, 8, 12 and the like different from the above mentioned standard rotation angle.

In most cases, such special multi-rotation type potentiometer was usually made by a hand-made work, such as making new parts for the potentiometer, modifying respective parts of the mass-produced potentiometer and remodelling the existing multi-rotation type potentiometer one by one. As compared with the multi-rotation type potentiometer mass-produced, the thus manually constructed multi-rotation type potentiometer becomes extremely expensive and takes a lot of time for its production. In addition, such potentiometer tends to become a make-shift product and is generally unreliable in efficiency and in quality.

It is, on the other hand, proposed that two sliding members are incorporated into a mass-produced standard multi-rotation type potentiometer and rotation angles of the sliding members of the potentiometer are adjusted within a range smaller than a rotation angle of the potentiometer at every rotation of an integer by short-circuiting the two sliding members. However, particularly when this adjusting method is applied to the multi-rotation type potentiometer that is frequently used as a precision potentiometer, there arise the following defects.

That is, the rotation angle of the sliding members and the resistance value of the potentiometer are adjusted by using the two sliding members so that these sliding members increase the contact points to five positions unlike the standard potentiometer having three contact points at most. As a result, the increase of the contact points gives rise to the increase of the mal-contact of the sliding members.

Further, since a contact made of a noble metal is used as the contact portion of the sliding member of the potentiometer, the number of the contact portion which is most expensive in the parts of the potentiometer is increased. Hence, the manufacturing cost of the potentiometer is increased.

Furthermore, there occurs a problem on the linearity which is the most important factor of the multi-rotation type potentiometer. That is, while two separate sliding members are slidably moved on and along the resistance element, they short-circuit the resistance element so that the short-circuit interval of the resistance element is fluctuated dependent on the rotary positions of the sliding members. Thus, different from the inherent linearity of the resistance element, the linearity of the multi-rotation type potentiometer is deteriorated by the fluctuation of the short-circuited interval by the sliding members.

Furthermore, since there are used two sliding members, the number of sliding contacts on the resistance element is increased, thus reducing the life span of the multi-rotation type potentiometer.

Therefore, according to the prior art method as described above, the multi-rotation type potentiometer produced in this way becomes expensive and poor in quality as compared with the standard multi-rotation type potentiometer mass-produced.

OBJECTS AND SUMMARY OF THE INVENTION

Accordingly, it is an object of this invention to provide an improved multi-rotation type potentiometer.

It is another object of this invention to provide a multi-rotation type potentiometer which can be produced by utilizing parts of a standard multi-rotation type potentiometer and which is high in efficiency and in reliability.

It is a further object of this invention to provide a multi-rotation type potentiometer in which a rotation angle of its sliding member can be limited to any rotation angle freely.

It is yet further object of this invention to provide a multi-rotation type potentiometer which can be produced at low cost.

According to one aspect of the present invention, there is provided a multi-rotation type potentiometer comprising:

(a) a cylindrical-shaped housing member having a spiral-shaped screw groove formed on its inner surface;

(b) a spiral-shaped resistance element having a predetermined number of turns and received by said screw groove of said housing member;

(c) two end terminals respectively attached to said housing member one ends of which are respectively connected to both ends of said resistance element through connection leads;

(d) a rotarty shaft attached with a cylindrical rotor, said rotary shaft rotatably assembled to said housing member such that said cylindrical rotor is located within said housing member along its center axis;

(e) a slipping lever fixed to an outer surface of said cylindrical rotor along its axis direction;

(f) a ring-shaped sliding member having inner and outer contacts and a guide member and engaged with said rotor such that when said rotary shaft and hence said rotor are rotated, said sliding member is rotated together with said rotor and also slid in an up and down direction on said rotor by an engagement of said guide member with said resistance element, while its inner and outer contacts respectively contact with said slipping lever and said resistance element;

(g) an output terminal having a slip-ring and attached to said housing member such that said slip-ring contacts with one end of said slipping lever; and (h) a stopper member screwed into said housing member to prevent said sliding member from being rotated at a revolution number exceeding a predetermined revolution number.

These and other objects, features and advantages of the present invention will become apparent from the following detailed description of the preferred embodiment that is to be read in conjunction with the accompanying drawings, in which like reference numerals identify like elements and parts.

DESCRIPTION OF THE PREFERRED EMBODIMENT

Now, an embodiment of a multi-rotation type potentiometer according to the present invention will hereinafter be described with reference to the attached drawings.

At first, a prior art standard multi-rotation type potentiometer to which the present invention is applied will be explained with reference to FIG. 1 which is an exploded perspective view thereof.

Figure 1:
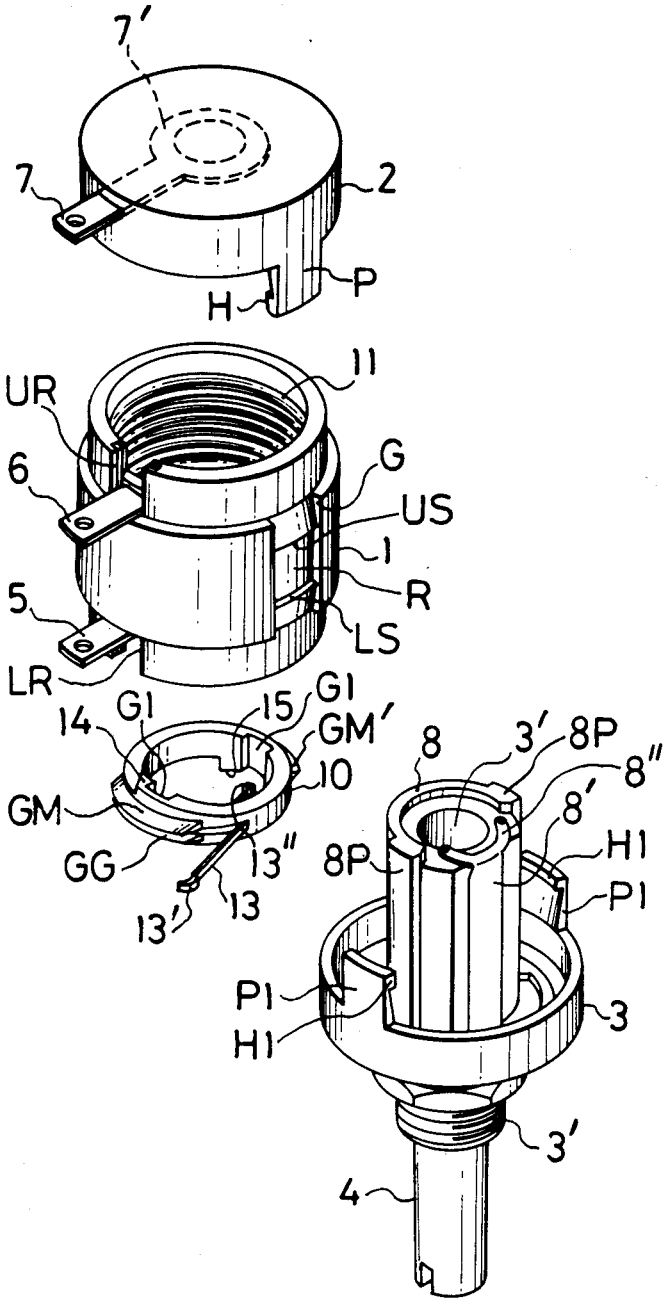
FIG. 1 (PRIOR ART)
FIG. 1 is an exploded perspective view illustrating an example of a prior art standard multi-rotation type potentiometer to which the present invention is applied.

Referring to FIG. 1, there are shown a casing or housing member 1 which is made of, for example, resin and generally formed of a cylindrical shape, a cap-shaped lid member 2 which is made of such as resin and engaged with the upper portion of the housing member 1 and a cap-shaped panel member 3 which is also made of resin and engaged with the lower portion of the housing member 1. In detail, as shown in FIG. 1, the lid member 2 is provided with a pair of projections P which are respectively projected downwards from the lower periphery of the cylindrical portion of the lid member 2 at positions angularly spaced apart from each other by about 180° and have inwardly protruded hooks H at lower end portions thereof, although only one projection P and so on are shown in FIG. 1. While, a pair of grooves G are formed on the outer surface of the housing member 1 which are respectively elongated in the up and down direction and angularly spaced apart by about 180°, although only one groove G is shown in FIG. 1. A recess R is formed on the bottom of each groove G so as to provide upper and lower step portions US and LS which are respectively extended in the lateral or horizontal direction. When the lid member 2 is assembled to the housing member 1 at its upper portion, each projection P is received by each groove G and each hook H is engaged with each upper step portion US so that after the lid member 2 is assembled to the housing member 1, the lid member 2 does not easily come off from the housing member 1. As shown in FIG. 1, the panel member 3 is provided with a pair of projections P1 which are respectively projected upwards from the upper periphery of the cylindrical portion of the cap-shaped panel member 3 at positions angularly spaced apart from each other by about 180° and have inwardly protruded hooks H1 at upper end portions thereof. When the panel member 3 is assembled to the lower portion of the housing member 1, each projection P1 is received by each groove G and each hook H1 is engaged with the lower step portion LS so that after the assembling, the former does not easily come off from the latter. The housing member 1, the lid member 2 and the panel member 3 form the housing of the multi-rotation type potentiometer.

At the center of the panel member 3, there is provided a bearing portion or bushing 3' by which a rotating shaft 4 is rotatably supported. End terminals 5 and 6 are respectively attached to lower and upper recess portions LR and UR which are formed on the peripheral wall of the cylindrical housing member 1. On the inside of the lid member 2, there is provided a slip ring 7' (shown by a broken line in FIG. 1) which is coupled together with a sliding contact terminal 7 protruded outside from the lid member 2. The slip ring 7' slidably contacts with a tip end portion 8'' of a slipping lever 8' fixed to a sleave-shaped rotor 8 into which fixed is the rotary shaft 4 to be rotated together with the same and positioned within the housing member 1 along its center axis when assembled. This slip ring 7' or terminal 7 serves as an external output path of the potentiometer. A screw groove 20 is formed on the inner peripheral surface of the housing member 1 so as to keep a spiral shaped resistance element 11 (see FIG. 2). Both ends of the resistance element 11 kept in the screw groove 20 are respectively connected to the end terminals 5 and 6 by connection leads 17 and 18, respectively (see FIG. 2).

A ring-shaped sliding member 10 is provided. As shown in FIG. 1, this sliding member 10 is provided on its outer peripheral surface with guide members GM and GM' which oppose to each other through the center of the sliding member 10. The guide member GM has a guide groove GG on its outer surface. This sliding member 10 is further provided on its inner peripheral surface with longitudinally or vertically extended grooves G1 at the positions angularly spaced apart from each other by about 180°. While, as shown in FIG. 1, the rotor 8 is provided on its outer surface a pair of projections 8P which are respectively elongated along the axis direction of the rotor 8 and at the positions angularly spaced apart from each other by about 180°. The sliding member 10 is assembled to the rotor 8 in such a manner that the projections 8P of the rotor 8 are slidably engaged with the grooves G1 of the sliding member 10, respectively. Thus, when the rotor 8 is rotated, the sliding member 10 is also rotated and moved up and down along the rotor 8, while its guide member GM receiving the spiral-shaped resistance element 11 in their guide grooves GG. In that case, outer and inner sliding contacts 13' and 13'' of the contact lever 13 made of electrically conductive material and attached to the sliding member 10 are slidably connected or contacted with the resistance element 11 and the slipping lever 8', respectively (see FIG. 2). At the end of rotation of the sliding member 10, one of upper and lower convex portions 14 and 15 formed on upper and lower surfaces of the ring-shaped sliding member 10 abuts against a convex portion or stepped portion (not shown) of the lid member 2 or the panel member 3, thus inhibiting the sliding member 10 from being moved further.

Figure 2:
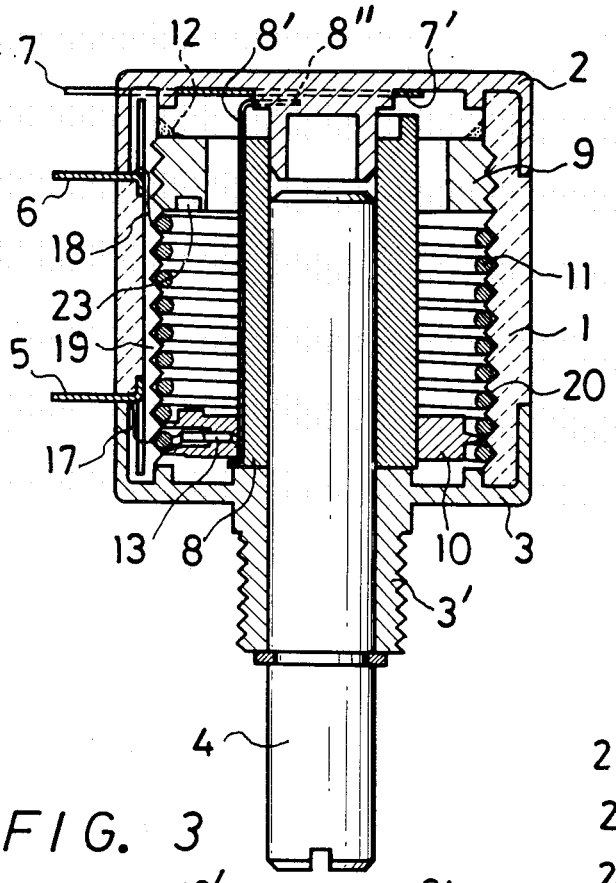
FIG. 2 is a schematic cross-sectional view illustrating an embodiment of a multi-rotation type potentiometer according to the present invention.
Figure 3:
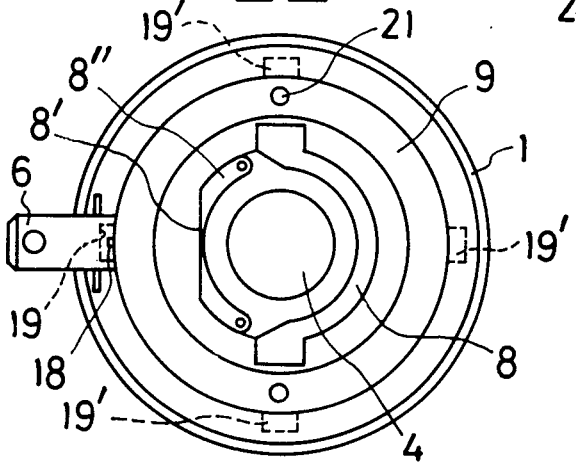
FIG. 3 is a top view of the embodiment of the invention shown in FIG. 2 in which a lid member is removed for better understanding of the invention.

FIG. 2 is a schematic cross-sectional view illustrating an embodiment of the multi-rotation type potentiometer according to the present invention and FIG. 3 is a top view of FIG. 2 in which the lid member 2 is removed from the housing member 1 of the potentiometer for better understanding. Throughout FIGS. 2 and 3, like parts corresponding to those in FIG. 1 are marked with the same references and will not be described in detail.

Figure 4:
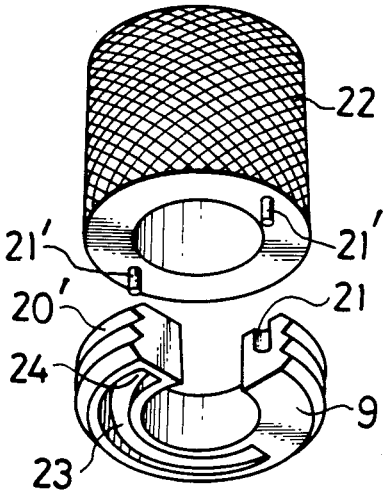
FIG. 4 is a perspective view illustrating an example of means for inserting an additional stopper member of this invention into a housing of the potentiometer.

Referring to FIGS. 2 and 3, there is provided an additional stopper member 9 which is made of, for example, resin and which is a main element of the invention. As shown in FIG. 4 which perspectively shows the additional stopper member 9 and its jig 22 used to insert the former to the housing member 1, the additional stopper member 9 is formed of a ring or cylindrical shape and provided on its outer periphery with a male screw 20' which is so formed that the male screw 20' can be screwed into the female screw 20 of the housing member 1. Further, in order that the additional stopper member 9 can be inserted into the housing member 1 by the jig 22, for example, a pair of joggle openings 21 (only one of them is shown in FIG. 4) are formed on the upper surface of the additional stopper member 9. In FIG. 4, a part of the additional stopper member 9 is cut away for better understanding.

Referring to FIG. 4, the jig 22 is provided on its lower surface with a pair of pins 21' which are respectively engaged with the joggle openings 21 of the additional stopper member 9 when it is inserted into the housing member 1. Alternatively, instead of the joggle openings 21, a screw driver groove may be formed on the upper surface of the additional stopper member 9 so that the additional stopper member 9 can be easily inserted into the housing member 1 by using a screw driver or the like. Further, the additional stopper member 9 is provided on its lower surface with a proper stepped portion 24 as a stopper member used to prevent the sliding member 10 from being rotated unnecessarily. For example, a groove 23 with an inclination large enough to accept the upper convex portion 14 of the sliding member 10 is formed on the lower surface of the additional stopper member 9 at the side facing the sliding member 10 when assembled and the stepped portion 24 is formed at a desired position of this groove 23.

After the additional stopper member 9 is inserted into the housing member 1 by meshing the male screw 20' of the additional stopper member 9 with the female screw groove 20 (where, of course, there is no resistance element 11) of the housing member 1 from, for example, its upper open end to a predetermined or desired rotation angle position necessary for a desired multi-rotation type potentiometer by the jig 22 or the screw driver and the like, the additional stopper member 9 is fixed to the inner peripheral surface of the housing member 1 by a bonding agent 12 as shown in FIG. 2 so as to prevent the rotation angle of the additional stopper member 9 from being changed unnecessarily. Alternatively, it may be possible to fix the additional stopper member 9 to the housing member 1 by inserting a pin or screwing a screw from the outer periphery of the housing member 1 to the additional stopper member 9 inserted instead of the bonding agent 12.

In FIGS. 2 and 3, reference numeral 19 designates a groove formed on the inner surface of the housing member 1 and vertically extended along the center axis of the housing member 1 in which the above mentioned connection leads 17 and 18 are received so as to prevent them from unnecessarily contacting with the resistance element 11. This groove 19 may be provided at four positions on the circumference equally divided by four as shown by reference numerals 19' in FIG. 3 on the basis of a rotation angle to be set as will be described later.

With the thus constructed additional stopper member 9, the rotation angle of the multi-rotation type potentiometer or its rotatable sliding member 10 can be limited to a desired rotation angle.

Since the spiral resistance element 11 is generally manufactured as a continuous and long coiled one, according to this invention, the long spiral resistance element is cut to pieces each having a length corresponding to a necessary rotation angle. Accordingly, although the above mentioned prior art using the two sliding members always requires the resistance element 11 having the length corresponding to the maximum rotation angle, according to the present invention, it is possible to save the expensive resistance element.

While the groove 19 for receiving the connection leads 17 and 18 is formed on the inner surface of the housing member 1 to guide the connection leads 17 and 18 to the end terminals 5 and 6, this groove 19 may be provided at any position. For example, when the groove 19 is located at the four positions on the circumference of the housing member 1 equally divided by four as shown in FIG. 3, for example, the end terminal 6 is located in each groove 19 and one end of the connection lead 18 connected thereto is connected to the resistance element 11 at the position opposing to that end terminal 6, it is possible to obtain a rotary type potentiometer having an arbitrary rotation angle at every 0.25 ($\frac{1}{4}$) rotation.

As set forth above, according to the present invention, it becomes possible to obtain a special multi-rotation type potentiometer having an arbitrary rotation angle which is the same in quality as the standard multi-rotation type potentiometer mass-produced and which can be produced at low cost.

The above description is given on a single preferred embodiment of the invention but it will be apparent that many modifications and variations could be effected by one skilled in the art without departing from the spirits or scope of the novel concepts of the invention so that the scope of the invention should be determined by the appended claims only.

I claim as my invention

1. A multi-rotation type potentiometer comprising:

(a) a cylindrical shaped housing member having a spiral-shaped screw groove formed on its inner surface;

(b) a spiral-shaped resistance element having a predetermined number of turns and received by said screw groove of said housing member;

(c) two end terminals respectively attached to said housing member one ends of which are respectively connected to both ends of said resistance element through connection leads;

(d) a rotarty shaft attached with a cylindrical rotor, said rotary shaft rotatably assembled to said housing member such that said cylindrical rotor is located within said housing member along its center axis;

(e) a slipping lever fixed to an outer surface of said cylindrical rotor along its axis direction;

(f) a ring-shaped sliding member having inner and outer contacts and a guide member and engaged with said rotor such that when said rotary shaft and hence said rotor are rotated, said sliding member is rotated together with said rotor and also slid in an up and down direction on said rotor by an engagement of said guide member with said resistance element, while its inner and outer contacts respectively contact with said slipping lever and said resistance element;

(g) an output terminal having a slip-ring and attached to said housing member such that said slip-ring contacts with one end of said slipping lever; and (h) a stopper member screwed into said housing member to prevent said sliding member from being rotated at a revolution number exceeding a predetermined revolution number.

2. A multi-rotation type potentiometer as claimed in claim 1, in which said additional stopper member is provided on its outer peripheral portion with a screw portion which is engaged with said screw groove of said housing member.

3. A multi-rotation type potentiometer as claimed in claim 2, in which said additional stopper member is provided on its upper surface with a pair of joggle openings so as to be inserted into said housing member by using a jig.

4. A multi-rotation type potentiometer as claimed in claim 2, in which said additional stopper member is provided on its upper surface a screw driver groove so as to be inserted into said housing member by a screw driver.

5. A multi-rotation type potentiometer as claimed in claim 1, in which said additional stopper member is fixed to said housing member by a bonding agent.

6. A multi-rotation type potentiometer as claimed in claim 1, in which said additional stopper member is fixed to said housing member through a pin or a screw.

7. A multi-rotation type potentiometer according to claim 1, further comprising a groove portion located on a circumference of a housing portion of said potentiometer so as to keep said connection leads therein.

8. A multi-rotation type potentiometer as claimed in claim 5, in which said groove portion is located at four positions on said circumference which are equally divided by four.

9. A multi-rotation type potentiometer as claimed in claim 1, in which said additional stopper member is provided with means for stopping the rotation of said sliding member.

* * * * *